US005565838A

United States Patent [19]

Chan

[11] Patent Number: 5,565,838

[45] Date of Patent: Oct. 15, 1996

[54] VARISTORS WITH SPUTTERED TERMINATIONS

[75] Inventor: Ning-Huat Chan, Myrtle Beach, S.C.

[73] Assignee: AVX Corporation, Myrtle Beach, S.C.

[21] Appl. No.: 243,110

[22] Filed: May 16, 1994

Related U.S. Application Data

[60] Continuation-in-part of Ser. No. 101,900, Aug. 3, 1993, abandoned, which is a division of Ser. No. 890,654, May 28, 1992, abandoned.

[51] Int. Cl.[6] ..... H01C 7/10

[52] U.S. Cl. ..... 338/21; 338/331

[58] Field of Search ..... 338/20, 21, 331

[56] References Cited

U.S. PATENT DOCUMENTS

| | | | |
|---|---|---|---|
| 3,627,662 | 12/1971 | Feuersanger . | |
| 3,787,312 | 1/1974 | Wagner et al. . | |
| 3,856,654 | 12/1974 | George . | |
| 3,900,432 | 8/1975 | Marcus et al. . | |
| 4,094,761 | 6/1978 | Wilson . | |
| 4,290,041 | 9/1981 | Utsumi et al. . | |
| 4,377,541 | 3/1983 | Bobik . | |
| 4,383,237 | 5/1983 | Eda et al. . | |
| 4,453,199 | 6/1984 | Ritchie et al. . | |
| 4,480,261 | 10/1984 | Hattori et al. . | |
| 4,561,954 | 12/1985 | Scrantom et al. . | |
| 4,584,629 | 4/1986 | Garcia et al. | 361/321.3 |
| 4,640,860 | 2/1987 | Ritchie . | |
| 4,652,967 | 3/1987 | Sakabe et al. | 361/309 |
| 4,658,328 | 4/1987 | Sakabe | 361/309 |
| 4,706,060 | 11/1987 | May | 338/20 |
| 4,741,077 | 5/1988 | Langlois | 29/25.42 |
| 4,766,409 | 8/1988 | Mandai | 338/22 R |
| 4,785,276 | 11/1988 | May | 338/21 |
| 4,819,128 | 4/1989 | Florian et al. . | |
| 4,917,642 | 4/1990 | Nakahashi et al. . | |
| 5,056,702 | 10/1991 | Nakahashi et al. . | |
| 5,162,973 | 11/1992 | Miyashita et al. | 361/308.1 |
| 5,166,759 | 11/1992 | Ueno et al. | 257/624 |
| 5,241,094 | 10/1993 | Amano et al. | 361/308.2 |
| 5,369,390 | 11/1994 | Lin et al. | 338/21 |
| 5,412,357 | 5/1995 | Nakamura et al. | 338/21 |

FOREIGN PATENT DOCUMENTS

| | | |
|---|---|---|
| 0333149 | 3/1989 | European Pat. Off. . |
| 0363673 | 9/1989 | European Pat. Off. . |
| 2555361 | 5/1985 | France . |
| 2106714 | 4/1983 | United Kingdom . |

OTHER PUBLICATIONS

Abstract of "Electrode production on metal oxide varistors—by sputtering thin metal layer on varistor, then depositing thicker conductive metal layer", Derwent Publications Ltd., London, GB; AN 79–48373, Anonymous.

Abstract of "Electrode applying device for voltage non–linear resistor", Patent Abstracts of Japan, vol. 15, No. 348 (E–1107) 4 Sep. 1991 & JP3133102 (erroneously reported by the EPO as "JP–A–03133302"), (Meidensha Corp.) 6 Jun. 1991.

*Primary Examiner*—Teresa J. Walberg
*Assistant Examiner*—Raphael Valencia

[57] ABSTRACT

The invention provides a varistor with sputtering terminations. In one aspect, the invention includes a varistor body with electrodes internal to the body except at spaced apart regions of the body, and sputtered terminations on the spaced apart regions of the body. In another aspect of the invention, embodiments include terminations comprised of metals from the from the group consisting of chromium, nickel, palladium, silver, tin, vanadium and mixtures thereof. In another aspect, embodiments of the invention include a passivation layer on outer surfaces of the varistor.

20 Claims, 6 Drawing Sheets

VARISTORS WITH SPUTTERED TERMINATIONS

CROSS-REFERENCE TO RELATED APPLICATIONS

This is a continuation-in-part of application Ser. No. 08/101,900, filed Aug. 3, 1993, now abandoned, which, in turn, is a divisional of application Ser. No. 07/890,654, filed May 28, 1992, now abandoned.

BACKGROUND OF THE INVENTION

1. Field Of The Invention

This invention relates generally to varistors, and more particularly to multilayer ceramic varistors having sputtered terminations.

2. The Related Art

"Varistors" or voltage-dependent nonlinear resistors have been used as, among other things, surge absorbing elements, arresters and voltage stabilizer elements. Varistors typically employ single layer, disk-shaped ceramic bodies having voltage-dependent nonlinearity. Multilayer varistors became available in the market in 1988. The preparation and typical composition of this type of varistor is described in detail in U.S. Pat. No. 4,290,041 to Utsumi et all. which is incorporated herein by reference. The varistor may comprise a semiconducting block-shaped body made up of conducting grains separated by voltage sensitive grain boundaries. The ceramic material is typically a zinc oxide blend. After formation of the varistor's ceramic body it is necessary to "terminate" the varistor, that is, to apply conductive coatings to the exposed electrode portions of the varistor. This permits the varistor to be readily connected to a printed circuit board or the like.

In a typical method of manufacturing varistors, termination is achieved by applying paste to the surfaces of the ceramic body having exposed electrodes. The paste may comprise a low melt glass frit and a conductive material such as silver or a silver alloy. After application of the paste, the varistor is heated to drive off solvents and/or binders and to fuse the glass and silver composition to the ceramic body. The terminated varistors may have electrical leads soldered to them or be used as surface mount devices.

The described method has drawbacks. First, the terminating compound can be very costly if palladium, platinum, and/or other noble metals are added to improve leach resistance. The cost of the added materials can be ten times or more than that of silver alone. Improving leach resistance is necessary as nickel-plated terminations have become an industrial standard for surface-mount components. Second, even when palladium and other noble metals are added to the termination compound, the resulting leach resistance will not be as good as that of the terminations including a nickel barrier. To reduce cost and improve leach resistance, attempts have been made to provide varistors with a nickel barrier by a plating operation. For example, a plurality of varistors already terminated and fired with silver terminations may be placed in a plating basket in a known technique for plating ceramic capacitors. The basket is then immersed in a plating solution. After sufficient metal has been deposited, the basket is removed from the plating solution and the varistors are cleaned.

This plating operation has a number of drawbacks. One difficulty resides in the fact that the varistor is a semiconductor made up of conducting grains separated by voltage sensitive grain boundaries. This sensitivity to voltage change subjects the varistor to "creepage" during the plating process. Creepage is the phenomenon where plating covers not only the end portions of the body (as it is supposed to), but begins to plate or "creep" from the end portions across the entire body from end to end. Of course, when the creepage reaches from end to end shorting occurs and the varistor is useless. This problem can be eliminated by applying an insulating compound such as a plastic binder over the areas where plating is not desired. However, this requires an added step to the process and adds to the manufacturing costs. Furthermore, the plating solution is generally acidic and will gradually etch the ceramic body if contact is made during plating.

Additionally, a zinc oxide varistor may degrade when subjected to elevated temperatures in a reducing atmosphere during processing, such as sputtering. In addition, lead injection of electrodes, which is sometimes used in manufacturing multilayer components, is carried out in a reducing atmosphere at elevated temperatures. Such processing conditions may cause unstable electrical properties when the varistor is under a voltage stress. Such unstable electrical properties lead to a decreased varistor life.

It is believed that applicant is the first to successfully apply terminations with a nickel barrier to varistors by a vacuum deposition method known in the industry as sputtering. Sputtering avoids the problems and costs inherent in either a paste or a plating operation.

Sputtering is advantageous in that it is possible to deposit extremely thin layers of metallic material with the assurance that all surfaces subjected to the deposition procedure will be intimately engaged by the deposited metal. Thus, only the desired portion of the varistor will be contacted by the termination material. Thus, sputtering achieves favorable results over the plating of varistors with less problems and at a much lower cost.

However, a difficulty inherent in sputtering the termination materials still resides in that the deposited increments of metal will be received by all exposed portions of the varistor. Thus, unless the side faces of the varistor, that is, the faces between the ends to which terminations are to be applied are completely shielded from the sputtering operation, there is substantial likelihood of forming a film of sputtered material extending between the ends of the varistor, thereby short-circuiting the varistor. In addition, as noted above, the varistor material may suffer degradation of electrical properties when subjected to a reducing atmosphere at elevated temperatures, such as those encountered during sputtering.

In order to render sputtering commercially feasible as a means of terminating varistors, it is important that hundreds or even thousands of varistors be simultaneously treated. While conceptually sputtering could be simultaneously applied to a plurality of varistors imbedded in a plastic block or the like, the difficulties in aligning the varistors, casting the block, removing the surface portions of the block to expose the terminal ends of the varistors and dissolving the block after sputter applications, renders the method commercially impractical.

The applicant has used several techniques for sputtering terminations on varistors. One technique for effecting sputtered termination of varistors is the "close-pack method." In this technique, sputter termination is applied by fitting a plurality of varistors into a specially formed metallic jig or die which so closely embraces the sides of the varistors as to preclude the formation of a film of sputtered material on the side faces of the varistors during metal deposition. In effect, the surrounding ceramic bodies adjacent to a particular body provide the "mask" for the side faces of that body. Thus, this method requires that the fabrication of the bodies and the loading of the die be of precise dimensions capable of handling large quantities of varistors in a single run.

Another technique is to sputter the terminations on the ceramic bodies while shielding the portions of the varistors which are to remain free of sputtered material by implanting the varistors in an elastomeric block or slab having apertures sized to intimately engage side portions of the varistors while exposing their ends. This technique is described in detail as being applicable to capacitors in U.S. Pat. No. 4.,561,954 to Scrantom et al. ("Scrantom") which is incorporated herein by reference.

When the length of the mask is slightly less than the length of the capacitor, Scrantom permits the manufacture of "lands," terminated end portions which cover not only the ends of the capacitors but extend slightly along the side margins of the capacitors.

The technique of Scrantom is useful for applying terminations to the ends of varistors, but limits the number of varistors that can be terminated at one time since the elastomeric mask occupies a significant portion of the area where additional varistors could be located in the close-pack method.

Additionally, while such elastomeric material form an adequate shield, the material tends to "out-gas" in the course of the sputtering operation which is necessarily carried out under vacuum conditions. The result of such "out-gasing" is the formation at the interface between the deposited sputtered material and the varistors, of foreign increments or inclusions. The increments or inclusions result in the sputtered material making poor electrical contact with the electrodes and having poor adhesion with the ceramic. However, prior application to the mask of a sputtering layer or layers can avoid the out-gasing problem while leaving the mask sufficiently deformable to permit the varistors to be bodily shifted from a load plate into complemental positioned apertures formed in the plate.

There is thus a need to develop a commercially practical method which combines the advantage of the close-pack method for high-density loading and of the elastomeric block method for the ability to provide "lands." It would be desirable if the technique also could be used not only to apply terminations to varistors, but terminations to other electrical components such as capacitors and resistors. Additionally, it would desirable if the technique permitted the manufacture of "lands" like the elastomeric method described in Scrantom without "robbing" useful space in the die where additional varistors could be placed. This simply cannot be achieved in the close-pack method.

SUMMARY OF THE INVENTION

The present invention provides for varistors having sputtered terminations. In one aspect the invention provides for a varistor body having a plurality of electrodes internal to the body except at spaced apart regions of the body, and a plurality of sputtered terminations disposed at the spaced apart regions. In another aspect of the invention, embodiments include terminations comprised of metals from the group consisting of chromium, nickel, palladium, silver, tin, vanadium and mixtures thereof.

In another aspect, certain embodiments of the invention include a varistor having a passivation layer on outer surfaces of the varistor body. The passivation layer may include at least one element selected from the group of lithium, sodium, and potassium.

Embodiments of the invention also include a block shaped varistor having opposing ends and a plurality of ceramic layers and a plurality of electrodes, including a passivation layer on the surface of the ceramic layers and sputtered terminations, wherein the sputtered terminations cover a portion of the passivation layer.

BRIEF DESCRIPTION OF THE DRAWINGS

Further objects, features and advantages of the invention will become apparent from the detailed description, below, when read in conjunction with the accompanying drawings in which.

DETAILED DESCRIPTION OF THE PREFERRED EMBODIMENTS

Figure 1:
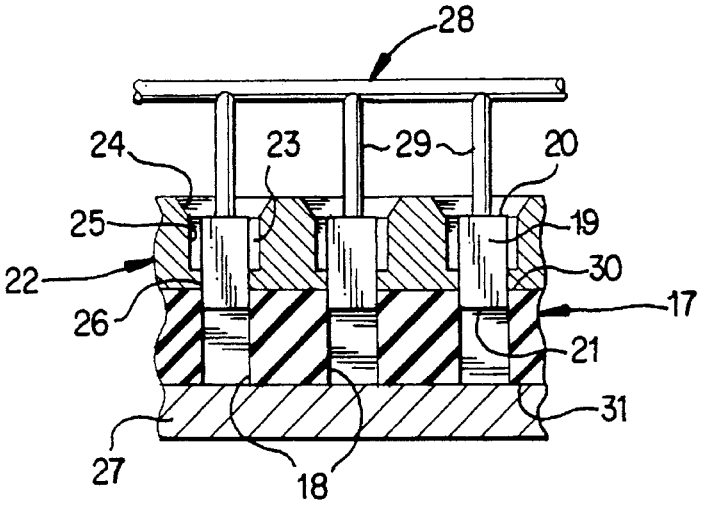
FIG. 1 is a diagrammatic fragmentary sectional view of an apparatus which may be used to practice the invention, showing portions of a loading mechanism and mask during initial stages of loading of varistors into the mask.

The following description is made for the purpose of illustrating the principles of the invention and should not be taken in a limiting sense. The scope of the invention should be determined by reference to the appended claims. It will be apparent that for clarity, dimensions and layers are not shown to scale in the drawings.

Figure 4:
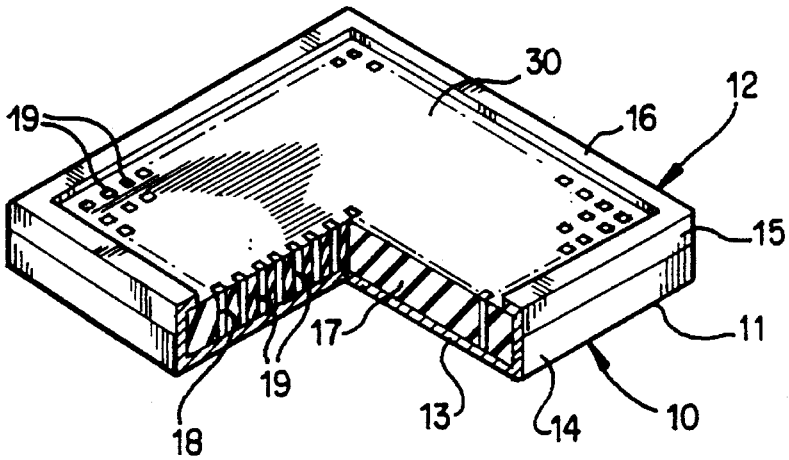
FIG. 4 is a perspective view on a smaller scale of the filled jig or frame assembly ready to be introduced into the sputtering apparatus, with portions of the apparatus cut away to show interior detail.

FIG. 4 is a perspective view of a fixture or assembly for holding varistors or the like for introduction into a sputtering apparatus. The fixture includes a bottom frame portion 11 and an upper frame component 12. The bottom frame 11 comprises a base portion 13 and a surrounding side wall portion 14. The upper frame component 12 includes a side wall portion 11 and an inwardly directed lip portion 16. The frame encompasses a mask 17 formed of an elastomeric material.

A preferred elastomer for the mask 17 is silicone rubber such as that sold under the registered trademark SILASTIC and manufactured by the Dow Corning Corporation of Midland, Mich. A preferred grade for the application is J RTV Silicone Rubber. Alternative silicone rubber compositions may also be used.

Figure 2:
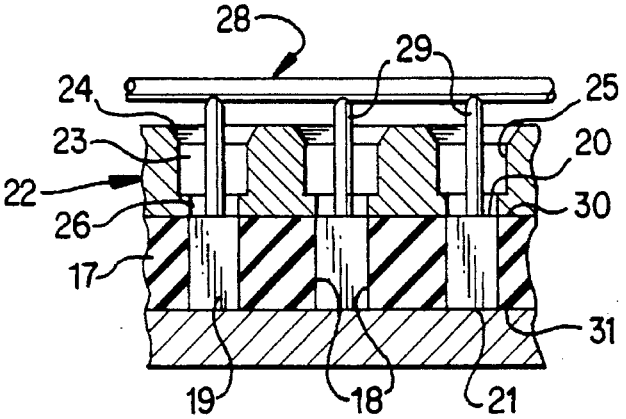
FIG. 2 is a section similar to FIG. 1 showing the position of the loading assembly components after the varistors have been inserted into position within the mask member.
Figure 3:
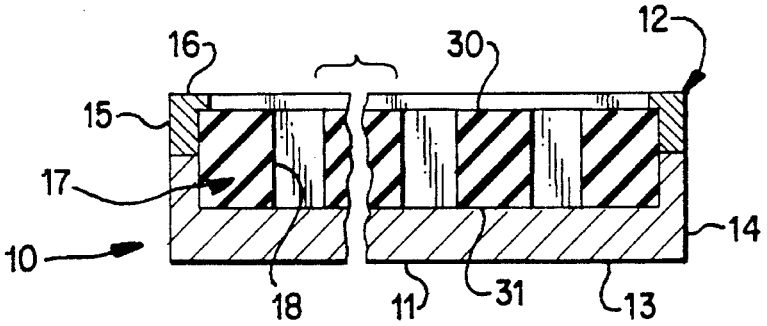
FIG. 3 is a fragmentary sectional view of the mask shown in FIG. 1 inserted in a jig or frame adapted to be introduced into the sputtering apparatus.

The mask 17 as shown in FIGS. 1, 2 and 3, includes a plurality of apertures 18 of a size which intimately embrace varistors 19 which are to be terminated at their opposite ends 20 and 21.

As will be understood by those of ordinary skill in the art relating to manufacture of electrical components, varistors 19 are manufactured in a manner which causes the electrodes to be exposed at one or the other of the end faces 20 or 21. The terminations function as an anchor point for leads or the like so the varistor can be coupled to an electrical circuit.

FIGS. 1 and 2 illustrate an apparatus for introducing the varistors into the apertures 18 in the mask 17.

It will be appreciated that for economical manufacture each mask may desirably include thousands of apertures. In order to facilitate filling the multiple apertures of the mask there is provided a load plate 22 which is provided with a plurality of apertures 23 corresponding in number and position with the apertures 18 of the mask 17. The apertures 23 of the load plate include tapered or funnel like lead portions 24 of a size significantly larger than the cross-section of the varistors 19, the lead portion 24 merging with a guide portion 25 and finally a discharge portion 26. The dimensions of the guide portion 25 are slightly larger than the cross-sectional dimensions of the varistor and function to guide the varistors into the discharge portion 26, which latter portion is sized to closely correspond with the cross-sectional dimensions of the varistors.

In practice, the load plate 22 may be filled by placing the plate beneath a bulk supply of varistors, the plate being vibrated or reciprocated in a horizontal plane for a period of time during which period varistors are caused by the vibratory movement to enter into the various apertures 23. After a period of oscillation or vibration beneath the bulk supply, the plate 22 is removed and continuously caused to vibrate. After a period of time the varistors will have reached positions wherein one or the other of the end portions 20 or 21 will have progressed at least into the guide portion 25 of the apertures 23 of the load plate.

The filled load plate 22 is thereafter superposed over mask 17 in a fixture. The fixture is provided with a back-up plate 27 disposed beneath mask 17. The fixture is disposed within a loading jig assembly which includes a pusher grid 28 having a plurality of depending pusher rods 29 spaced to register with the apertures 23 of the load plate. The pusher grid 28 is thereafter shifted down so as to force the varistors out of the load plate 22 and into the apertures 18 of the mask 17.

In FIG. 1 the pusher grid 28 is disclosed as having descended part way down such that the lower terminal ends 21 of the varistors have been caused to enter part way into the elastomeric mask 17.

In FIG. 2 the grid 28 is shifted to its lowermost position with the result that the varistors 19 have been advanced into the mask 17 such that the upper and lower ends 20, 21 of the varistors are in substantial co-planar alignment with the upper and lower surfaces 30, 31 of the mask 17. Due to the elasticity and deformability of the mask 17 the varistors will be retained by friction of the mask in the position noted.

Additionally, the flexibility of the mask enables the varistors to be forced into this position despite a slightly imperfect alignment of the lower ends 21 of the varistors with the uppermost ends of the apertures 18. Where such slight misalignment occurs the downward pressure on the varistors is sufficient to deform the mask whereby the downwardly moving varistor is forced into the slightly misaligned aperture in the mask.

The filled mask is mounted within the fixture as best illustrated in FIG. 4.

In this mounted position, the side margins of the mask abut against the inner surfaces of the sidewall 14 of base plate 11. Thereafter the upper frame member 12 is clamped over the base plate 11 such that the sidewalls 15 of the frame 12 abut the side margins of the mask 17 above side wall 14, and the lip 16 of the frame overlaps the top surface 30 of the mask adjacent an edge portion thereof.

As will be understood from the detailed description set forth below, the sputtering process necessitates subjecting the components to be sputtered to vacuum conditions. Thus, a high failure rate will be engendered by the tendency of the elastomeric materials employed to "out-gas" progressively under vacuum conditions.

As a result of the "out-gasing," a predictable adhesion of the sputtered metal to the exposed electrode layers will not be obtained. Instead a multiplicity of glassy inclusions will result with concomitant poor adhesion of metal to electrodes and unpredictability as to the number of electrodes to which good contact was obtained.

Figure 1A:
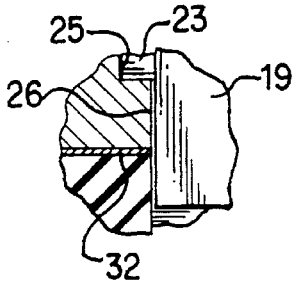
FIG. 1*a* is a magnified fragmentary view of a portion of the apparatus illustrated in FIG. 1.

The "out-gasing" problem can be solved by subjecting the mask 17, prior to loading, to a sputtering step to deposit a thin metallic film over the surfaces 30, 31 of the mask. The thickness of the film may be no more than a tenth of a micron or less, and functions to preclude out-gasing. Subsequent sputtering steps can be carried out whereby a pure metallic layer will cover both exposed ends of the varistors and the predeposited film. This is diagrammatically illustrated at 32 in FIG. 1*a*.

It will be understood that both the upper and lower surfaces 30 and 31 of the mask are subjected to the pre-sputtering step. After a sputter coating is effected over one of the surfaces 30 the mask is removed from the fixture and inverted so that a subsequent sputtering operation covers the surface 31 as well as the varistor ends 21 which are exposed when the mask is inverted.

After both surfaces of the mask and varistors have been sputtered, the varistors are removed from the apertures by a pusher grid assembly similar to grid 28. The grid assembly includes pusher rods which enter into the aligned apertures of the mask and drive the finished varistors from the apertures 18.

After removal of the varistors the mask may be refilled and reused without a prior pre-sputtering step, since the mask will include a metal coating comprised of the initial pre-sputtered coating as well as the over sputtering deposited on the surfaces of the mask by the sputtering procedure employed to terminate the varistors. The mask may be reused until the coating or build up on the surface of the mask renders the mask unduly stiff or resistant to deformation, following which it is necessary to chemically remove the metallic build-up from the surfaces of the mask, subject the mask to a further pre-sputtering step, and thereafter repeat the cycle.

Figure 5:
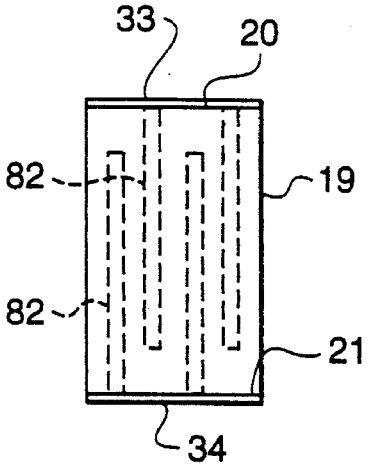
FIG. 5 is a side elevation view of a sputter terminated varistor.

There is shown in FIG. 5 a finished varistor 19 having upper and lower surfaces 20 and 21 to which have been applied metallic layers 33, 34, respectively. (internal electrodes 82 are shown in broken lines) Lead members may be soldered to the terminations 33, 34 by any of a number of conventional procedures.

Figure 6:
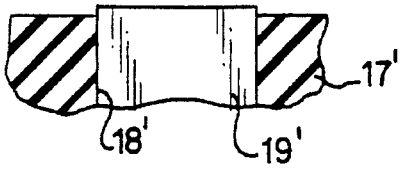
FIG. 6 is a fragmentary, sectional view of a varistor mounted in a mask in accordance with an embodiment of the invention.
Figure 7:
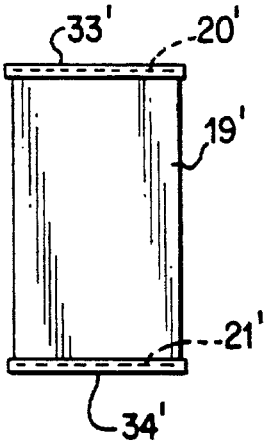
FIG. 7 is a terminated varistor formed in accordance with the embodiment shown in FIG. 6.

In FIG. 7, a varistor is shown which is similar to that shown in FIG. 5. The varistor of FIG. 7 differs from that of FIG. 5 in that the termination portions 33', 34' cover not only the ends' 20', 21' of the varistor 19', but also extend slightly along the side margins of the varistor. These structural features are referred to as "lands." The embodiment of FIG. 7 is fabricated by loading the varistors 19' into a mask 17' so that the upper and lower surfaces (only the upper surface being shown in FIG. 6) project slightly beyond the upper and lower margins of the mask 17'. This condition is achieved by using a mask of slightly lesser thickness than the length of the varistors and by introducing a slightly compressible layer between the undersurface of the mask 17' and load plate 27. Under such circumstances, the pusher rods 29 will force the lower ends of varistors 19' through the body of the mask 17' so that they indent slightly into the compressible layer. Both ends of the varistors will then project slightly above and below the upper and lower surfaces of the mask 17'. Thus, the masking method permits the manufacture of lands a feature which is not obtainable with the next method.

Another method for effecting sputtered termination of varistors is the close-pack method. In this technique, sputter termination is applied by fitting a plurality of varistors into a specially formed frame, such as a metallic jig or die, which so closely embraces the sides of the varistors as to preclude the formation of a film of sputtered material on the side-faces of the varistors during metal deposition. In effect, the surrounding ceramic bodies adjacent to a particular body provide the "mask" for the side faces of that body. This method requires that the fabrication of the bodies and the loading of the die be of precise dimensions capable of handling large quantities of varistors in a single run. Nevertheless, if this is not a problem due to the standardization of the size of those parts and high volumes, the method maximizes efficiency in sputtering the parts by using all of the available space within the jig or die because it does not include a mask between parts. Such a jig may be similar to the frame 42 shown in FIG. 10, without the spacing strips 60.

One aspect of the invention provides a preferred method combining the high manufacturing efficiency of the close-pack method. Additionally, if desired, the preferred method can provide for the formation of lands like the elastomeric masking method discussed earlier yet avoid the loss of useful area in the die for processing additional varistors. As will be seen, the method is not limited to applying terminations to varistors, but can be also used to apply terminations to other electrical components. For the sake of brevity, however, the method will be discussed in the context of sputtering terminations on varistors.

Figure 10:
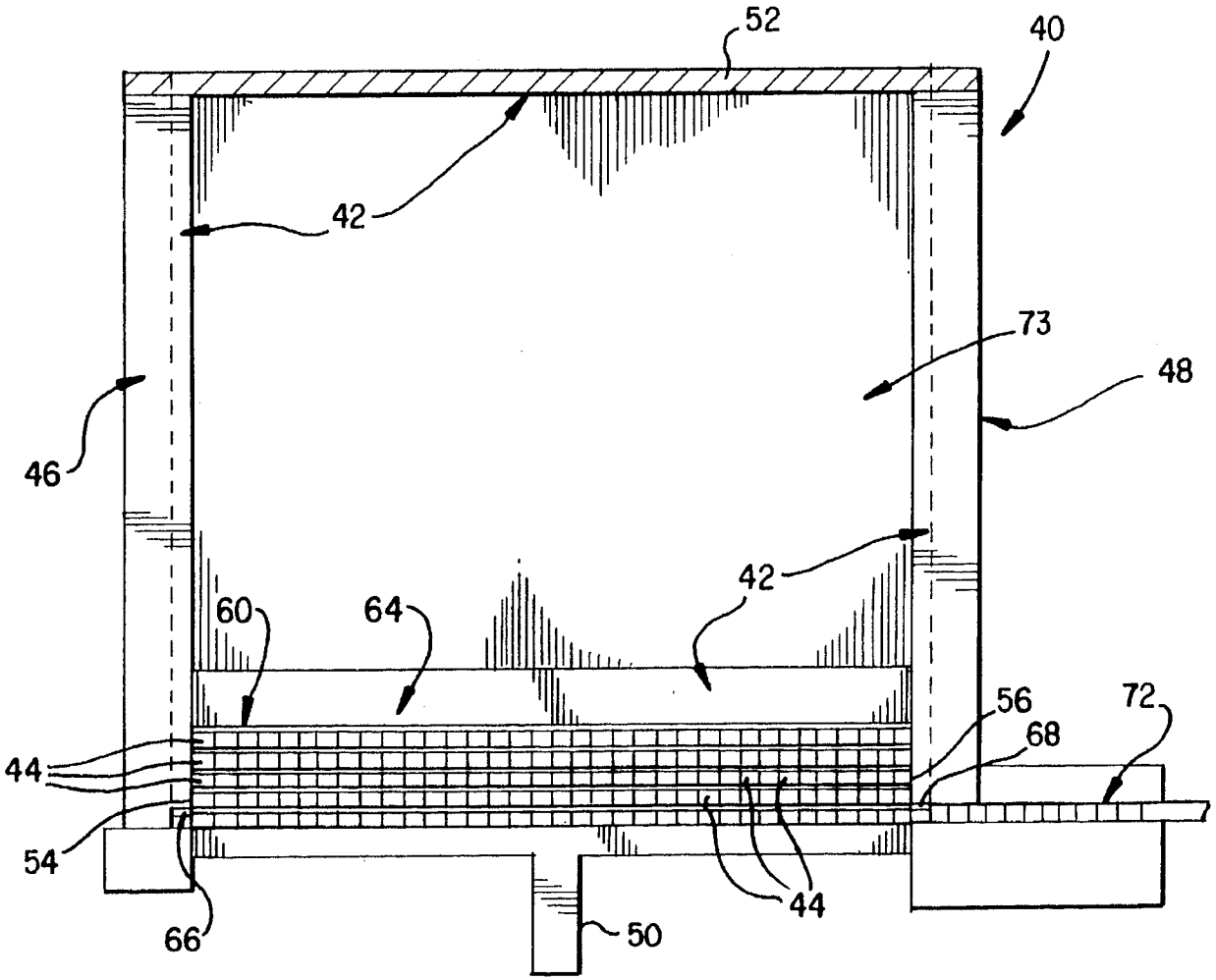
FIG. 10 is a plan view of a device for loading the apparatus of FIG. 8 and which includes a frame for holding the varistors in place during the sputtering process.

As shown in FIG. 10, in the preferred method, the invention provides a varistor loading device 40 including a movable frame 42. The frame 42, a bottom plate 73 and a closing bar 75 (FIG. 11) attached after loading is completed serve to hold the varistors 44 during the sputtering process. As with the previous methods, the frame 42 is square or rectangular-shaped. However, in contrast to the previous methods, the frame 42 changes dimensions during the loading sequence.

Figure 11:
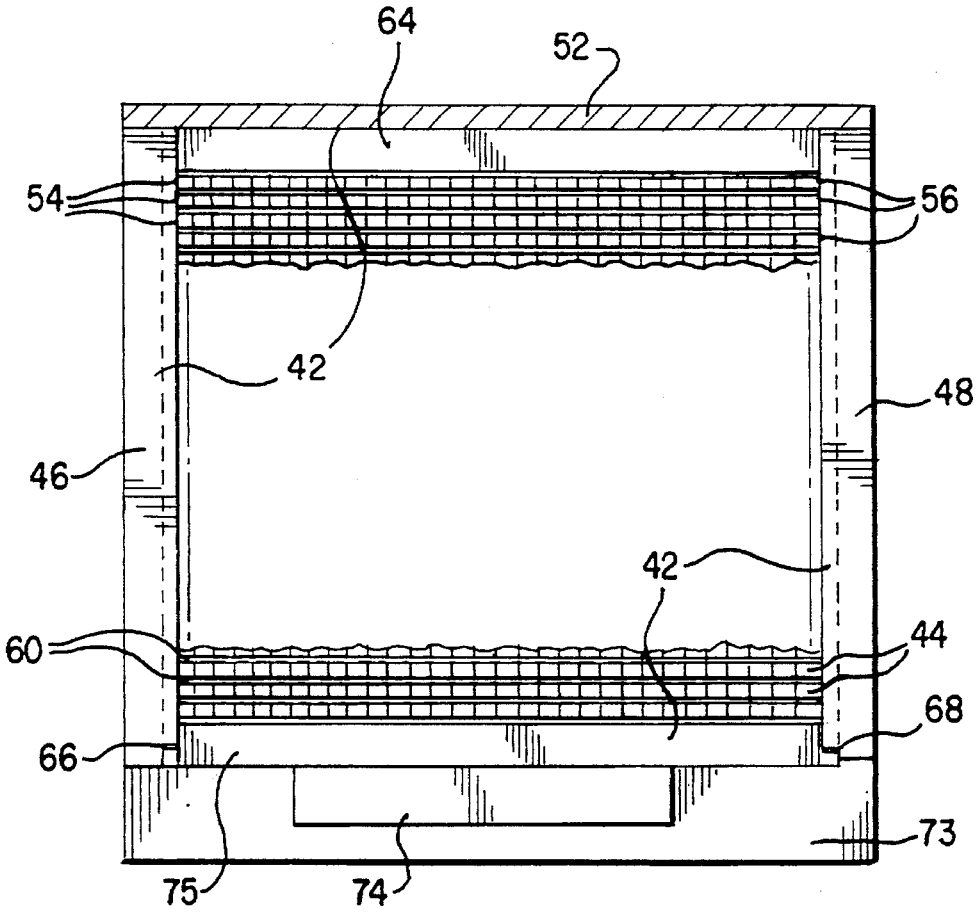
FIG. 11 is a plan view of a fully loaded apparatus (with varistors in the middle portion of the apparatus not shown) which shows a frame, a plate and a retainer forming parts of the apparatus of FIG. 8.

FIG. 11 illustrates that the frame 42 may be made up of two holding bars 46, 48, a movable bar 64 and a closing bar 75. The holding bars 46, 48 are parallel to one another. The sliding bar 64 and closing bar 75 are also parallel to one another. Each holding bar 46, 48 is connected at one of their ends to the stop bar 52 where the movable bar 64 rests when the plate is fully loaded forming a three-sided "fixed" portion of the frame 42. The closing bar 75 is the "fourth side" of the frame 42. The two holding bars 46, 48 of the frame 42 are in a fixed relationship during the loading and sputtering process, whereas the movable bar 64 moves incrementally with each push of the push bar 50 during the loading sequence.

As shown in FIG. 10, the rows of varistors 44 are loaded into the frame 42 in predetermined lengths. The rows are oriented during the loading process so that they are parallel to the stop bar 52 and the push bar 50 and are confined at their ends 54, 56 by the holding bars 46, 48. The stop bar 52 will function to confine the total number of rows which can be loaded into the frame 42 as explained in the following discussion.

Figure 8:
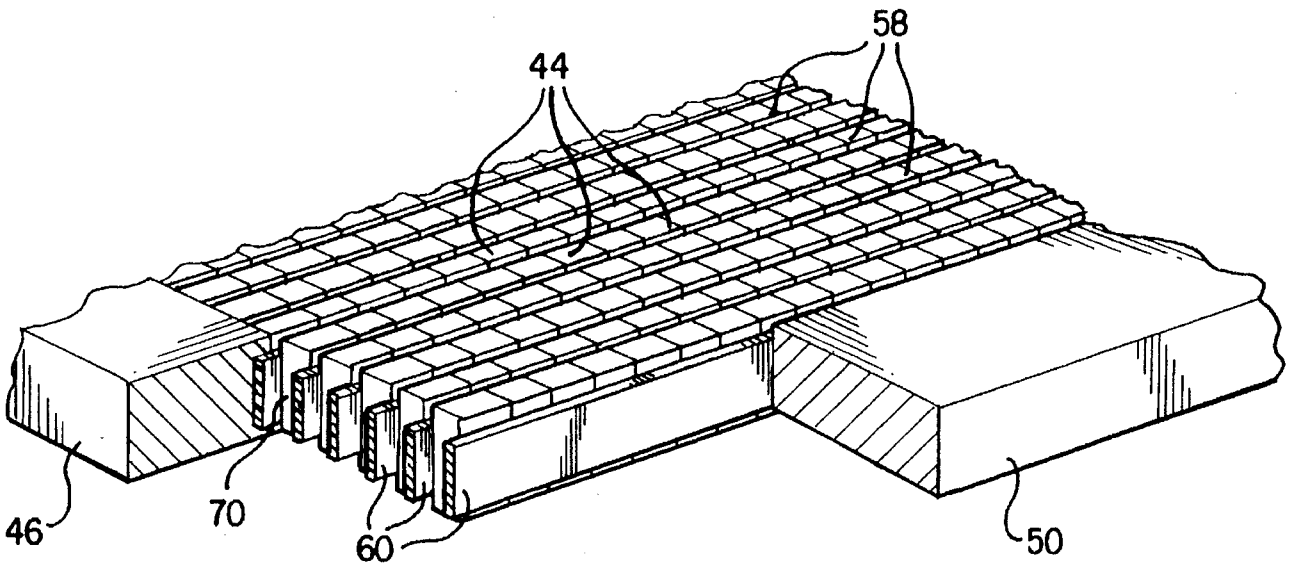
FIG. 8 is a partial perspective view of a preferred apparatus for practicing the invention including an arrangement of rows of varistors alternating with spacing strips in a frame and in which the spacing strips mask the row faces of the varistors and the adjacent varistors mask the column faces of the adjacent varistors within that row.

As shown in FIG. 8, the varistors 44 are packed transverse to the frame 42 so that only their ends 58 where the termination is to be applied is exposed. The varistors 44 are block-shaped, and serve as "masks" for their adjacent varistors 44 along the "column-face." A spacing strip 60 masks the "row face" of the varistors 44. In the illustrated embodiment of FIG. 8, the method provides that each row of varistors 44 is separated from the adjacent rows by spacing strips 60.

Figure 9:
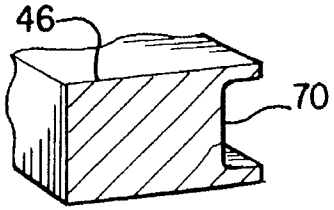
FIG. 9 is a fragmentary close-up sectional view of a holding bar forming part of the apparatus of FIG. 8.

In operation, the varistors 44 are loaded in the frame 42 for sputtering in the following manner (FIG. 10). First, a spacing loader 62 disposed above the frame 42 inserts a rectangular-shaped spacing strip 60 in front of the "open portion" of the frame 42 so that the strip 60 rests against a sliding bar 64 located in the frame 42 and parallel to the push bar 50. Each end of the strip 60 is initially held in a feed-in slot 66, 68 in each holding bar 46, 48. Subsequently, the strip 60 is held in a groove 70 in the holding bars 46, 48 (FIG. 9). Thus, initially, the strip 60 rests against the sliding bar 64.

A varistor feeder (not shown) located over the frame 42 feeds a row of varistors 44 into the frame 42 next to the strip 60. The row alignment device 72 packs the varistor row tightly together (from right to left) so that there are no "gaps" in the row. Next, the push bar 50 pushes the row of varistors 44, the strip 60, the sliding bar 64 as a "single unit" an incremental distance (i.e., one row width) into the frame 42. Thus, during the loading process, the row of varistors 44 are held together as a unit at their ends by the parallel holding bars 46, 48, and by the push bar 50 and the sliding bar 64. After a row of varistors 44 is pushed into the frame 42 the push bar 50 moves back out of the frame and the spacing loader 62 inserts another strip 60 next to the row of varistors 44 just inserted.

The process is then repeated until the entire frame 42 is filled with varistors 44, that is, when the sliding bar 64 contacts the stop bar 52 and can proceed no further. Once the frame 42 is filled, the closing bar 75 and the retainer 74 are attached (FIG. 11). The resulting assembly is then transported to a suitable work space for sputtering of the terminations of the varistors 44.

In one embodiment, the spacing strip 60 is rectangular-shaped and has a width which equals the end to end dimension or length of the varistors 44. Favorable results have been achieved when the spacing strip 60 is made of rigid plastic. However, any other materials of similar or greater rigidity such as metal may also be suitable. In another embodiment, the spacing strips can be omitted so that a true close-pack arrangement is achieved.

Figure 12:
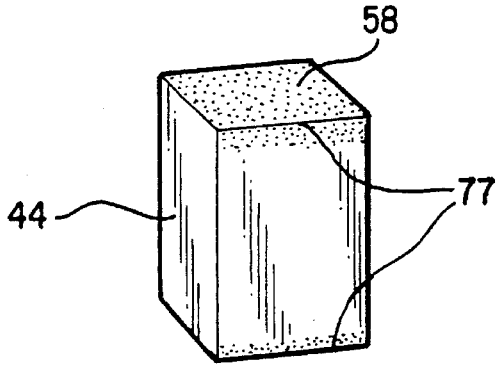
FIG. 12 is a perspective view of a sputtered varistor with sputtered ends and two-sided lands.

In yet another embodiment, the spacing strip 60 has a width slightly less than the length of the varistor 44. This latter embodiment permits the formation of terminations extending beyond the end faces of the varistors creating the so-called "lands" (FIG. 12). Thus, the end portions may optionally project slightly beyond the spacing material or may be flush with the spacing material.

In another aspect of the invention the surfaces of the varistors may be coated with a passivation layer prior to the sputtering of the terminations. This passivation layer helps prevent the degradation of the varistor material during exposure to high temperatures and reducing atmospheres. The passivation layer may have a variety of compositions. One example of a mixture used to fabricate the passivating layer is as follows:

| Component | Weight (g) | Weight Percent |
|---|---|---|
| $H_3BO_3$ | 5.10 | 43.2 |
| $Li_2CO_3$ | 1.65 | 14.0 |
| $SiO_2$ | 2.32 | 19.7 |
| $K_2CO_3$ | 0.836 | 7.1 |
| $Al_2O_3$ | 0.744 | 6.3 |
| $Cu_2O$ | 0.173 | 1.5 |
| $BaCO_3$ | 0.967 | 8.2 |
| TOTAL | 11.79 | 100 |

To the mixture listed above is added 11.7 grams of distilled water.

Other glass formula mixtures may be used for the coating material, for example, those containing sodium, lithium and/or potassium. The varistors may be coated using any number of techniques. For example, the coating materials can be combined with water, then the varistors tumbled in a basket in a tank containing the water and coating material. Once the varistors are coated, they are heat treated, for example, at a temperature of 750°–850° C. in air for 10 minutes. During this heat treatment, the coating reacts with the varistor material to form a passive surface coating.

It is believed that the passivation coating differs from a physical mask in that it is also a chemical barrier. It is thought that the coating material alters the chemical mass action relationship of surface ions so that creation of ionic defects internally is retarded when the device is exposed to a reducing atmosphere at high temperatures such as those encountered during sputtering or other processing steps such as lead injection of electrodes. Without the passivation coating the varistor material is more prone to degradation, which leads to instability in the varistor's electrical properties and decreased life.

Figure 13:
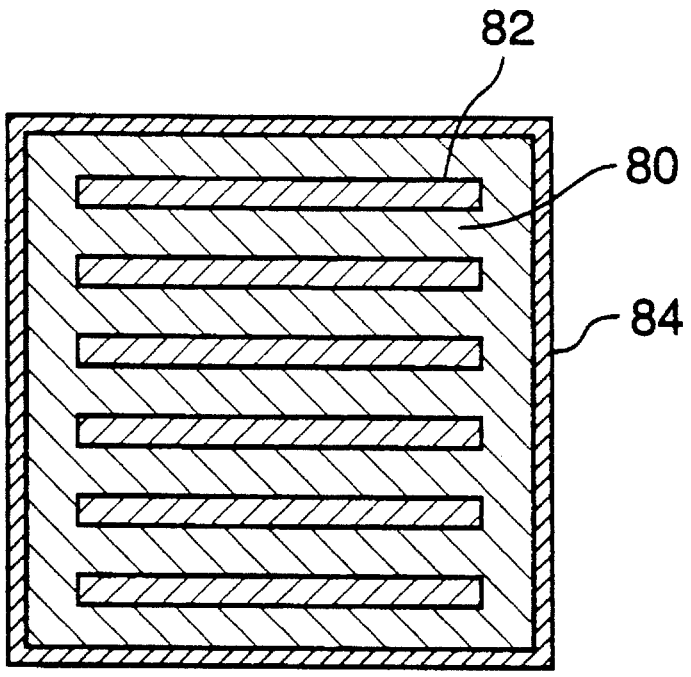
FIG. 13 is an end view, in section, of a varistor including a passivation layer applied prior to sputtering, in accordance with a method of the present invention.

FIG. 13 shows a varistor including a ceramic body 80, electrodes 82, and a passivation layer 84 covering the ceramic body 80. The thickness of the passivation layer 84 may vary considerably, and may, for example, be on the order of microns. In certain embodiments, by way of example only, the coating material may make up anywhere from 0.001% to 1% of the weight of the device.

The electrodes 82 do not react with the passivation layer 84 like the ceramic 80 does, and thus the layer 84 does not significantly affect the contact made between the electrodes 82 and the sputtered terminations (not shown) on the end faces of the varistor. However, if the layer 84 is thick enough to interfere with the electrical contact at the end faces, the faces can be cleaned prior to heat treatment so that good contact will be made between the end faces of the varistor and the sputtered terminations.

One preferred sputtering procedure is as follows. Prior to loading, the varistors, coated with the passivation layer, may be cleaned, if necessary, utilizing a conventional degreasing compound. The loaded varistors and precoated mask 17 are sputter coated by passing the same beneath the target of a sputtering device. Optionally, but preferably, an in-line sputtering system such as a system identified as the Series 900 Sputtering Device manufactured by Materials Research Corporation of Orangeberg, N.Y., may be employed.

An in-line sputtering system is preferred in that it permits the fixtures holding the varistors to be progressively advanced beneath target areas of different compositions whereby a layer of a first sputter deposited material may be formed directly over the exposed surface and thereafter a second and if desired a third layer applied. Prior to depositing any metal onto the devices, there may be included an etching step in argon in the sputtering chamber using argon, to enhance the adhesion of the sputtered material to the surface.

Desirably, a thin chromium layer (0.01 to 0.1 μm) may be applied to the varistor termination surface for adhesion. Thereafter, a thin layer nickel or nickel vanadium layer (0.1 to 2 μm) and a final silver or tin layer (1 to 15 μm). The nickel layer provides a barrier against leaching of the silver layer when electrical connections are soldered to the terminations of the varistors.

To complete the sputtering procedure, the assembly is placed in a vacuum load lock which is pumped to a pressure of less than $50\times10^{-5}$ torr and thereafter introduced into the main sputtering chamber.

Sputtering may be effected at a power level of 4.2 kilowatts and a scan speed on the order of 5 millimeters per second across the target area. Sputtering is performed preferably in an argon gas environment at a pressure of $10\times10^{-5}$ torr. Where a chromium substrate is used for a high adhesion layer, thicknesses in the range of 0.04 to 0.08 microns are preferred. A nickel coating of from 0.4 to 1.0 microns has been found to be optimum. Where a silver or palladium overcoating is to be employed a coating thickness of 1 micron has been found sufficient.

With reference to FIG. 11, after the sputtering of the first ends of the varistors 44, a separate plate 73 is attached to the frame 42 and the retainer 74 by screws and the whole assembly is flipped over. The top plate is then removed and the opposite ends may be sputtered.

When the mask employing the apparatus of FIGS. 1–4 is used, the precoating of the surfaces of mask 17 may be applied by using a chromium target material. In this event, the coating thickness is non-critical, but is initially in the range of about 0.15 microns. As previously noted, the initial chromium presputter coating will be oversputtered in the course of treating varistors and thus will increase significantly in thickness after being used for a series of varistor sputtering cycles.

From the foregoing, it will be apparent that there is shown and described a method for the effective termination of varistors of the multilayer type whereby a plurality of varistors may be simultaneously and effectively treated. By way of example and without limitation a mask of 4 inches by 4 inches may carry over thirteen hundred (1,300) "1206 style" varistors for simultaneous treatment in an elastomeric frame, as in FIG. 4; 5,700 varistors in a frame using spacing strips 60, as in FIGS. 8–11; and 7,400 varistors if such spacing strips are not used.

From the foregoing, it will be appreciated by those skilled in the art that there is shown and described a method of effectively terminating varistors by several different methods. Each method has certain advantages, with a preferred method, utilizing the apparatus of FIG. 11, combining several advantages of other methods in one operation.

It is also apparent that the methods can be used to effectively apply sputtered terminations on not only varistors, but other types of electrical components as well, including, capacitors, resistors, and surface mount fuses. Finally, numerous variations of the described procedures may readily occur to those skilled in the art once they have been made familiar with the disclosure of the present invention.

I claim:

1. A mulitlayer varistor comprising:

a ceramic body having two pairs of opposing side surfaces and first and second opposing end surfaces;

a plurality of electrodes internal to the ceramic body and extending to one of the first and second opposing end surfaces of the ceramic body;

a passivation layer disposed on the two pairs of opposing side surfaces and on the first and second opposing end surfaces of the ceramic body; and a first sputtered termination disposed over the passivation layer on the first opposing end surface of the ceramic body and a second sputtered termination disposed over the passivation layer on the second opposing end surface of the ceramic body.

2. The varistor of claim 1, wherein the material of the sputtered terminations includes nickel.

3. The varistor of claim 1, wherein the material of the sputtered termination is selected from the group consisting of chromium, nickel, palladium, silver, tin and vanadium and mixtures thereof.

4. The varistor of claim 1, wherein the varistor further comprises a plurality of ceramic layers, a plurality of electrode layers disposed adjacent to the ceramic layers, and wherein each sputtered termination connects to one end of at least one electrode layer.

5. The varistor of claim 1, wherein the material of the sputtered termination is selected from the group consisting of a chromium layer of about 0.01 to about 0.1 microns thickness, a nickel or nickel vanadium layer of about 0.1 to about 2 microns thickness and a silver or tin layer of about 1 to about 15 microns thickness and mixtures thereof.

6. The varistor of claim 1, wherein at least one sputtered termination includes a land projecting in at least one direction beyond at least one end surface.

7. A varistor comprising:

a ceramic body defining side surfaces and first and second end surfaces;

a plurality of electrodes internal to the ceramic body and extending to one of the first and second end surfaces, with every other electrode extending to the same end surface;

a passivation layer disposed on the side surfaces and on the first and second end surfaces of the ceramic body;

a first termination connecting electrodes at the first end surface; and a second termination connecting electrodes at the second end surface.

8. A varistor as in claim 7, wherein the first termination and the second termination each comprise a sputtered material and the first termination covers the passivation layer disposed on the first end surface and the second termination covers the passivation layer disposed on the second end surface.

9. The varistor of claim 7, wherein the passivation layer contains at least one element selected from the group of Li, Na, and K.

10. The varistor of claim 7, wherein the passivation layer comprises a glass formula.

11. The varistor of claim 7, wherein the material of the sputtered termination is selected from the group consisting of chromium, nickel, palladium, silver, tin, and vanadium and mixtures thereof.

12. The varistor of claim 7, wherein the material of the sputtered termination is selected from the group consisting of a chromium layer of about 0.01 to about 0.1 microns thickness, a nickel or nickel vanadium layer of about 0.1 to about 2 microns thickness, and a silver or tin layer of about 1 to about 15 microns thickness.

13. The varistor of claim 7, wherein at least one of the sputtered terminations includes a land projecting on at least one direction beyond at least one end surface.

14. The varistor of claim 7, wherein the passivation coating comprises a heat treated mixture of $HBO_3$, $Li_2CO_3$, $SiO_2$, $K_2CO_3$, $Al_2O_3$, $Cu_2O$ and $BaCO_3$.

15. A varistor as in claim 7, wherein the passivation layer comprises 0.001 to 1 percent by weight of the varistor.

16. A varistor comprising:

a body having opposing ends, the body comprising layers of voltage dependant resistive material and electrode material;

a heat treated passivation coating disposed on outer surfaces of the voltage dependent resistive material; and a termination covering each of the opposing ends of the body, the termination also covering the passivation coating on the voltage dependant resistive material at the opposing ends of the body.

17. A varistor as in claim 16, wherein:

the passivation coating comprises a glass material and is present in a quantity of 0.001 to 1 percent by weight of the weight of the varistor body; and the opposing ends of the varistor each have a sputtered termination comprising nickel and chromium.

18. A varistor body comprising:

a plurality of ceramic layers exhibiting voltage dependency;

a plurality of internal electrodes disposed between the ceramic layers, the internal electrodes having two ends, wherein one end of a first internal electrode extends to a first external location of the body and the opposing end of the first internal electrode is within the body, and wherein one end of a second internal electrode extends to a second external location, spaced from the first external location, and the opposing end of the second internal electrode is within the body;

a passivation layer coating all of the external surfaces of the ceramic layers; and sputtered terminations covering the passivation layer on the first and second external locations of the body, the terminations electrically contacting electrodes disposed at the first and second external locations.

19. A block-shaped varistor having a plurality of electrodes and having a plurality of ceramic layers having exposed outer side surfaces and two opposing end surfaces, the varistor comprising:

a passivation layer on exposed side surfaces and on the two opposing end surfaces of the ceramic layers; and sputtered terminations on the varistor, wherein the sputtered terminations cover the passivation layer on the two opposing end surfaces of the ceramic layers.

20. A multilayer varistor comprising a block shaped body having two pairs of opposite facing side surfaces and first and second opposite facing end surfaces;

the body including a plurality of ceramic layers, wherein the ceramic layers define the two pairs of opposite facing side surfaces and the first and second opposite facing end surfaces;

the body including a plurality of electrode layers disposed between ceramic layers, wherein each electrode layers extends to one of the first and second opposite facing end surfaces and every other electrode extends to the same end surface;

a heat treated passive surface coating disposed on the two pairs of opposite facing side surfaces and the first and second opposite facing end surfaces of the ceramic layers; and a first termination disposed at the first end surface of the ceramic layers, the first termination covering the heat treated passive surface coating disposed on the first end surface of the ceramic layers; and a second termination disposed at the second end surface of the ceramic layers, the second termination covering the heat treated passive surface coating disposed on the second end surface of the ceramic layers.

* * * * *